United States Patent [19]

Punako

[11] 4,326,768

[45] Apr. 27, 1982

[54] ELECTRICAL CONNECTOR GROUNDING STRAP CONNECTION

[75] Inventor: Stephen Punako, Bainbridge, N.Y.

[73] Assignee: The Bendix Corporation, Southfield, Mich.

[21] Appl. No.: 155,717

[22] Filed: Jun. 2, 1980

[51] Int. Cl.[3] ..... H01R 4/66

[52] U.S. Cl. ..... 339/143 R; 339/252 R; 339/256 RT

[58] Field of Search ..... 339/143 R, 252 R, 256 RT, 339/258 R, 258 A, 276 R

[56] References Cited

U.S. PATENT DOCUMENTS 4,239,318 12/1980 Schwartz ..... 339/252 R X 4,243,290 1/1981 Williams ..... 339/143 R

*Primary Examiner*—Eugene F. Desmond

*Attorney, Agent, or Firm*—Raymond J. Eifler

[57] ABSTRACT

A grounding strap (4) is secured to a connector shell (2) by a sleeve (5) which connects opposite ends of the strap together without the need for welding. The strap (4) reduces electromagnetic radiation passing through the shell and includes a plurality of very thin slits (43) that enable the grounding strap to be compressed radially inward when the connector shell (2) is mated to another connector shell.

2 Claims, 5 Drawing Figures

FIG. 1
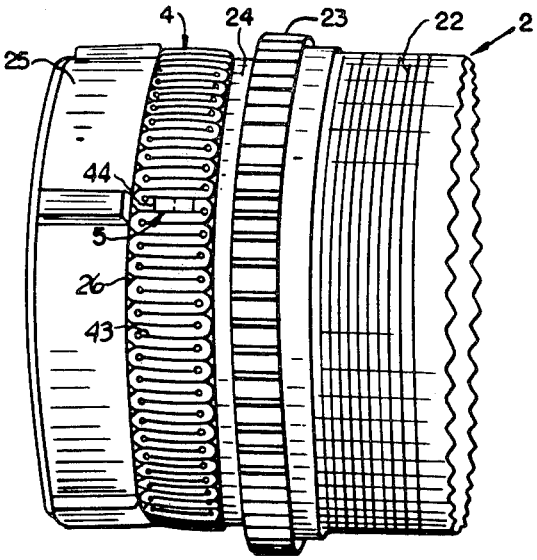
FIG. 5
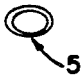
FIG. 2
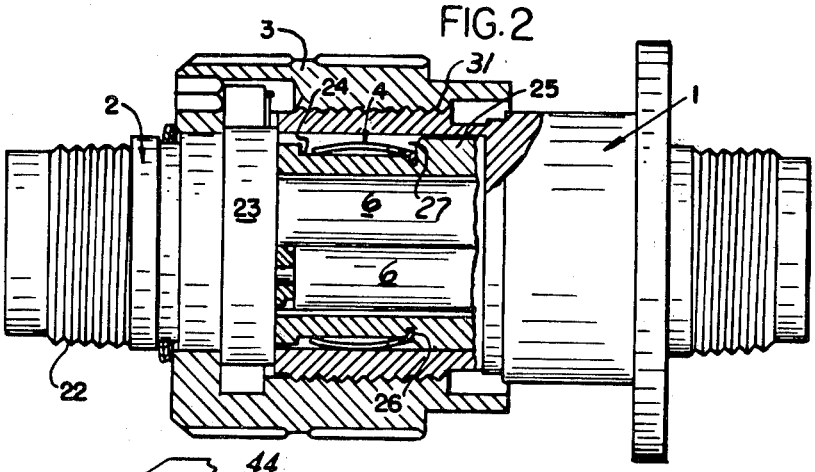
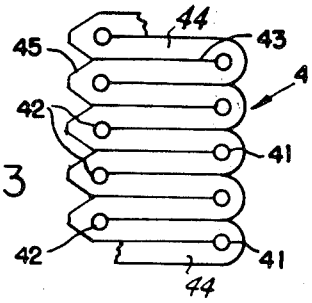
FIG. 3
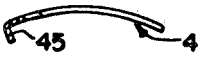
FIG. 4

ELECTRICAL CONNECTOR GROUNDING STRAP CONNECTION

The invention relates to electrical connectors of the type having mateable shells and a grounding strap secured to one of the shells to prevent electromagnetic radiation from entering the connector.

BACKGROUND OF THE INVENTION

Electrical connectors are used to connect together a plurality of electrical wires into predetermined circuit relationship with another plurality of electrical wires. The interconnected wires convey signals from one circuit to another. One example of such a connector may be found in U.S. Pat. No. 3,663,926 issued May 16, 1972 and entitled "Separable Electrical Connector". In some instances, the circuits are very sensitive or the signals being conveyed are very weak and electromagnetic radiation entering into the connector can interfere with the signals being communicated between the circuits. When this occurs false signals are conveyed between the circuits. If there is not good grounding between the interconnected connector shells and/or there are voids within the connector, electromagnetic radiation may enter and interfere with the circuitry. To provide good grounding and avoid voids for electromagnetic radiation to enter the connector, grounding straps are provided around one of the connector shells, The straps are wound and then welded.

When the connector is used in the field and the grounding strap broke, welding equipment, which is not readily available, was required to repair the grounding strap. When welding equipment was not available, repair of the connector was accomplished by the expensive and time consuming method of replacement.

DISCLOSURE OF THE INVENTION

An electrical connector of the type having mateable shells is provided with a grounding strap 4 on one of the shells that is secured to the shell by a sleeve 5.

The invention is an electrical connector of the type having mateable shells and a grounding strap 4 mounted to one of the shells and characterized by an oblong sleeve 5 which connects opposite ends of the strap together to secure the strap to the shell.

The main advantage of the invention is that the strap may be mounted to the connector shell without the need for welding tools. Further, since the sleeve is so easy to assemble onto the strap assembly time and costs are significantly reduced.

DETAILED DESCRIPTION OF THE INVENTION

FIG. 1 is a view of a connector shell with a grounding strap mounted thereon.

FIG. 2 is a cross-sectional view of an electrical connector assembly utilizing the grounding strap of this invention.

FIG. 3 is a detailed view of a portion of the grounding strap.

FIG. 4 is a side view of a grounding strap.

FIG. 5 is a side view of the sleeve used to connect the ends of the grounding strap.

Referring now to the drawings, FIG. 1 shows a connector shell 2 having mounted thereon a grounding strap 4. The connector shell generally includes a plurality of threads 22 for engaging another piece (not shown), an enlarged portion or shoulder 23, a recessed portion 24 and an end portion 25. The recess portion 24 receives the grounding strap 4 and also includes an annular groove 26 for receiving one end of the ground strap 4. Securing the ends of the grounding strap is a sleeve 5. The last leg 44 at each end of the grounding strap 4 extends through the sleeve 5, thereby securing the grounding strap 4 to the shell 2. The legs 44 are defined by slits 43 extending across the strap 4.

FIG. 2 illustrates the grounding strap 4 within a mated electrical connector. The electrical connector comprises: a first shell 1 having a plurality of electrical contacts 6 that mate with a plurality of contacts of a second shell 2. The first shell 1 and the second shell 2 are connected together by a coupling nut 3. The coupling nut is rotably mounted to the second shell and is coupled to the first shell by threads 31. When the connector is in the mated relationship as shown, the grounding strap 4 is in the void 27 which might otherwise allow electromagnetic radiation to pass through the connector and to the signal carrying contacts 6.

FIG. 3 illustrates the details of the grounding strap. The grounding strap is stamped and formed from a flat piece of beryllium copper. There are a plurality of holes 41 and 42 that align with slits 43 that define a plurality of legs 44. Each slit 43 extends from one edge of the strap to one of the holes 41, 42. The width of each slit is less than 0.005 inches, formed by shearing. A slot, which is larger than the slits, will allow electromagnetic radiation to pass through them. Accordingly, slots provide too much space for electromagnetic radiation to pass while a slit minimizes the space that electromagnetic radiation may pass into the connector. The noise level (electromagnetic radiation) attenuated by a grounding strap with slots (about 0.010 inches), on a mated connector was about 108–114 decibels. The attention of the noise level on the same connector and under the same conditions but with a grounding strap with slits 0.004 inches was 120–126 decibels. The slits eliminated high frequency noise which could pass through slots. The holes 41 on one side of the grounding strap are generally arranged on an axis that is parallel to the axis of the holes 42 arranged on the other side of the strap. Each slit 43, cut into the grounding strap, is along a second axis perpendicular to the parallel axis of the holes 41 and 42. Each second axis intersecting only one hole i.e. 41 or 42. The holes 41 and 42 provide strain relief i.e., prevent crack propagation that could cause the strap to break.

FIG. 4 illustrates how the grounding strap is formed to have a curvature and an end 45 which is bent at an angle of about 90° from the main body of the grounding strap 4. The curvature of the strap allows the strap to be compressed radially inward when the second shell 2 is mated with the first shell 1. The angled end portion 45 of the grounding strap is adapted to be placed in the groove 26 of the connector shell, shown in FIG. 2. The angled end 45 and the groove 26 assist in maintaining grounding strap along a predetermined path around the connector shell 2.

FIG. 5 illustrates a side view of the oblong sleeve 5 shown in FIG. 1. The oblong shape of the sleeve 5 minimizes the overall height of the sleeve so that it does not interfere with the mating of the connector shells 1 and 2.

While a prefered embodiment of the invention has been disclosed, it may be apparent to others skilled in the art that changes may be made to the invention as set forth in the appended claims and, in some instances certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with an electrical connector of the type having a first connector shell; a second connector shell; means for coupling said first shell to said second shell; a grounding strap wrapped around a portion of one of said shells to suppress electromagnetic radiation entering the connector, said grounding strap comprising: a flat elongated piece of electrically conducting material; a first plurality of holes arranged along a common axis along one of the elongated sides of the material; a second plurality of holes arranged along a common axis along the other elongated side of the material; and a plurality of slits in said material, each of said slits extending from one of said holes to the edge of the elongated side furthest from said hole to define a plurality of interconnected legs; and means for securing said strap to one of said shells, the improvement wherein said securing means comprises;

a sleeve for securing opposite ends of said grounding strap together, said sleeve having the last leg at each end of the grounding strap extending into said sleeve, thereby securing the strap to said one shell.

2. In combination with an electrical connector of the type having a connector shell, a grounding strap having a plurality of interconnected legs defined by a series of slits, said grounding strap wrapped around a portion of said shell, the improvement comprising:

a sleeve for securing opposite ends of said ground strap together, said sleeve having the last leg at each end of the grounding strap extending into said sleeve, thereby securing said grounding strap to said shell.

* * * * *